US006499854B2

(12) United States Patent
Chen

(10) Patent No.: US 6,499,854 B2
(45) Date of Patent: Dec. 31, 2002

(54) DECORATIVE WATER LAMP

(76) Inventor: Chaur-Bing Chen, No. 10, Alley 53, Lane 136, Shu-Te Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/862,370

(22) Filed: May 22, 2001

(65) Prior Publication Data

US 2002/0176246 A1 Nov. 28, 2002

(51) Int. Cl.[7] ..... F21V 33/00
(52) U.S. Cl. ..... 362/101; 362/96; 40/406
(58) Field of Search ..... 362/96, 101, 282, 362/284, 293, 328; 40/412, 406, 439, 409; 446/156, 157, 158

(56) References Cited

U.S. PATENT DOCUMENTS 4,215,500 A * 8/1980 Sharp ..... 40/409
5,272,604 A * 12/1993 Lin ..... 362/96
6,039,453 A * 9/2000 Wang ..... 362/101
6,270,420 B1 * 8/2001 Lee ..... 40/412

* cited by examiner

*Primary Examiner*—Stephen Husar
*Assistant Examiner*—Bao Truong
(74) *Attorney, Agent, or Firm*—Thorp Reed & Armstrong, LLP

(57) ABSTRACT

A decorative water lamp is composed of a base (10) with a projector (12) and a transmission device (11), an inner shell (20), a membrane fixer (30), and an outer shell (40) with a semi-spherical cover. The transmission device ( 11) comprises a plate (14) rotatably mounted on the projector (12) to create different colored lights, and the membrane fixer (30) has a deformable membrane (34) to stimulate water waves by the transmission device (11). The decorative water lamp has a specially dynamic and colorful visual effect.

10 Claims, 7 Drawing Sheets

DECORATIVE WATER LAMP

BACKGROUND OF THE INVENTION

1. Field of the Invention

The present invention relates to a decorative water lamp, and more particularly a water lamp with water waves to make the lamp have colorful and fantastic visual effects.

2. Description of Related Art

With the improvement of life quality, people have become interested in decorative lamps that can amplify or beautify their leisure time at home and decorative lamps have become more and more popular in households and restaurants. Recently, water lamps have become a current popular item in the lamp market and have created a lot of consumer interest. Two conventional water lamps in the market are shown in FIGS. 6 and 7. With reference to FIG. 6, a first conventional water lamp comprises a body (60) and a plurality of lamp sets (61). The body (60) has a positioning seat (62) and an upper cover (63) being installed above the positioning seat (62). A plurality of equal-spaced through holes (64) is formed in the upper cover (63); and the plurality of lamp sets (61) spaced apart from each other are positioned near the periphery of the body (60). Each of the lamp sets (61) has a reflecting mask which is matched with the respective through hole (64) of the upper cover (63). Each of the reflecting masks have a glass plate (65) located thereabove a bulb seat (66). Each of the bulb seats (66) has a bulb inserted therein. Thereby a container (67) can be positioned on the conventional lamp device and filled with water. When the bulbs of the plurality of lamp sets lit, light can be projected to the container (67) and the water via the reflecting masks so that the container and the water present a state of emitting light.

Now referring to FIG. 7, a second conventional water lamp includes a water container (70), a support base (71) located under the water container (70) and having an upper mouth (72), and a light emitter unit (73) fixed under the upper mouth (72) and having a plurality of light emitters (such as LEDs) of different colors to be lit up in various orders to shine into the water. Air is blown by a pump controller (74) through an air tube (75) extending in the water container (70) to produce water turbulence with colored lights transmitting therethrough from the light emitter unit (73). An electronic circuit (76) board powered by a power supplier (77) controls variations in the lighting up of light emitter unit (73).

The first conventional water lamp has only still light and monotonous scenery without any dynamic means, so that it is not attractive enough for the commercial market. As to the second conventional water lamp, the variation is only via changing speeds of the bubbles blowing from the bottom of the water container to the upper mouth, however, the light is also still and several light emitters are needed for making the water present several colors.

The present invention tends to provide a decorative water lamp to mitigate and obviate the aforementioned problems.

SUMMARY OF THE INVENTION

The main objective of the invention is to provide a decorative water lamp to creative novel and attractive visual effects.

Another objective of the invention is to provide a decorative water lamp which uses a small quantity of bulbs to save manufacturing cost.

Other objects, advantages and novel features of the invention will become more apparent from the following detailed description when taken in conjunction with the accompanying drawings.

DETAILED DESCRIPTION OF PREFERRED EMBODIMENT

Figure 1:
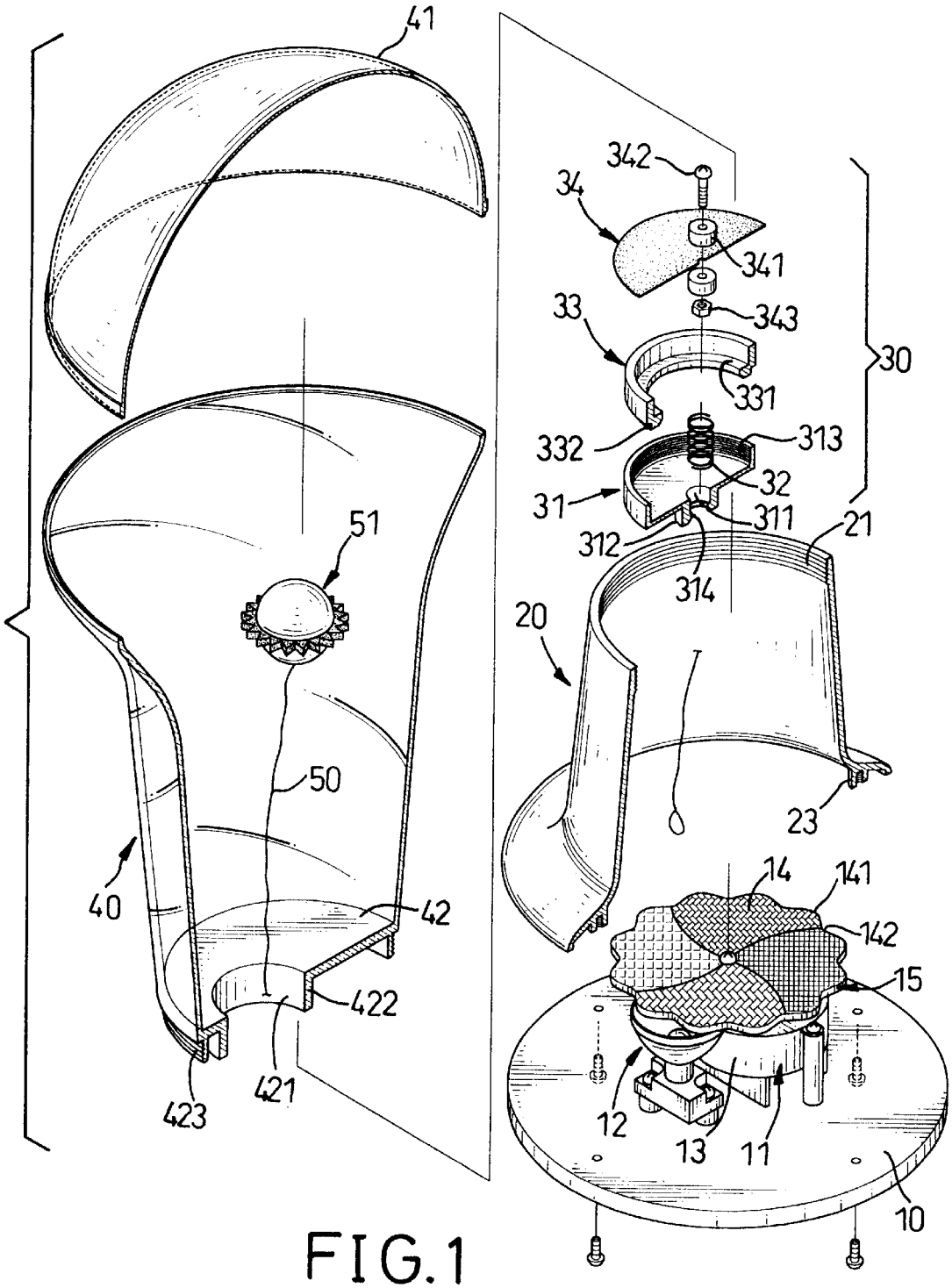
FIG. 1 is an exploded view of a decorative water lamp in accordance with the present invention.

With reference to FIG. 1, a decorative water lamp consists of a base (10) with a transmission device (11), an inner shell (20), a set of membrane fixer (30), an outer shell (40), and a float body (50).

The base (10) has the transmission device (11) and a projector (12) mounted thereon, and the transmission device (11) is composed of a reductive gear (13) and a plate (14) rotatably mounted on the reductive gear (13) to cover the projector (12). White light is emitted from the projector (12). The plate (14) is made of transparent material that is divided into several areas in different colors and has a wavy edge (15) with a series of crests (141) and troughs (142).

The inner shell (20) is a tapered hollow cylinder with a thread (21) formed on an inner top face of the inner shell (20), and multiple screw holes (23) defined in a foot portion of the inner shell (20) to secure the inner shell (20) on the base (10).

The membrane fixer (30) has a fixing cap (31), a spring (32), a fixing ring (33), and a resilient membrane (34), and the membrane fixer (30) is secured under the outer shell (40) by clipping the resilient membrane (34) between the fixing ring (33) and the outer shell (40). The fixing cap (31) has a through hole (311) defined in a center thereof with a ring (312) formed downwardly around the through hole (311) and a threaded side wall (313) formed around an inner periphery of the fixing cap (31). The ring (312) has an outwardly tapered portion (314) at the distal end. The fixing ring (33) has a flange (331) inwardly formed at a bottom edge, with a threaded cutout (332) being defined in the corner between the flange (331) and the fixing ring (33) to mate with threaded side wall (313) of the fixing cap (31). The resilient membrane (34) is sandwiched by two pressure plates (341) with a set of a bolt (342) and a nut (343).

The outer shell (40) is made of transparent material and has a tapered body with a semi-spherical cover (41) mounted at the top and a plate (42) formed at the bottom. The plate (42) has a round aperture (421) defined therein and a support wall (422) downwardly protruded around the aperture (421) to fit in the fixing ring (33). A connecting ring (423) is formed downwardly from the plate (42) with a threaded outer face to correspond to the thread (21) of the inner shell (20). The outer shell (40) is filled with water when the decorative water lamp is assembled.

A float line (50) has one end tied on a float body (51) and the other end fixed on the base (10). The line (50) extends from the base (10) to the through hole (311) and a middle part of the line touches the wavy edge (15) of the plate (14). The line (50) extends through the through hole (311) and is firmly secured on the membrane fixer (30) to drag the resilient membrane (34) to deform.

Figure 2:
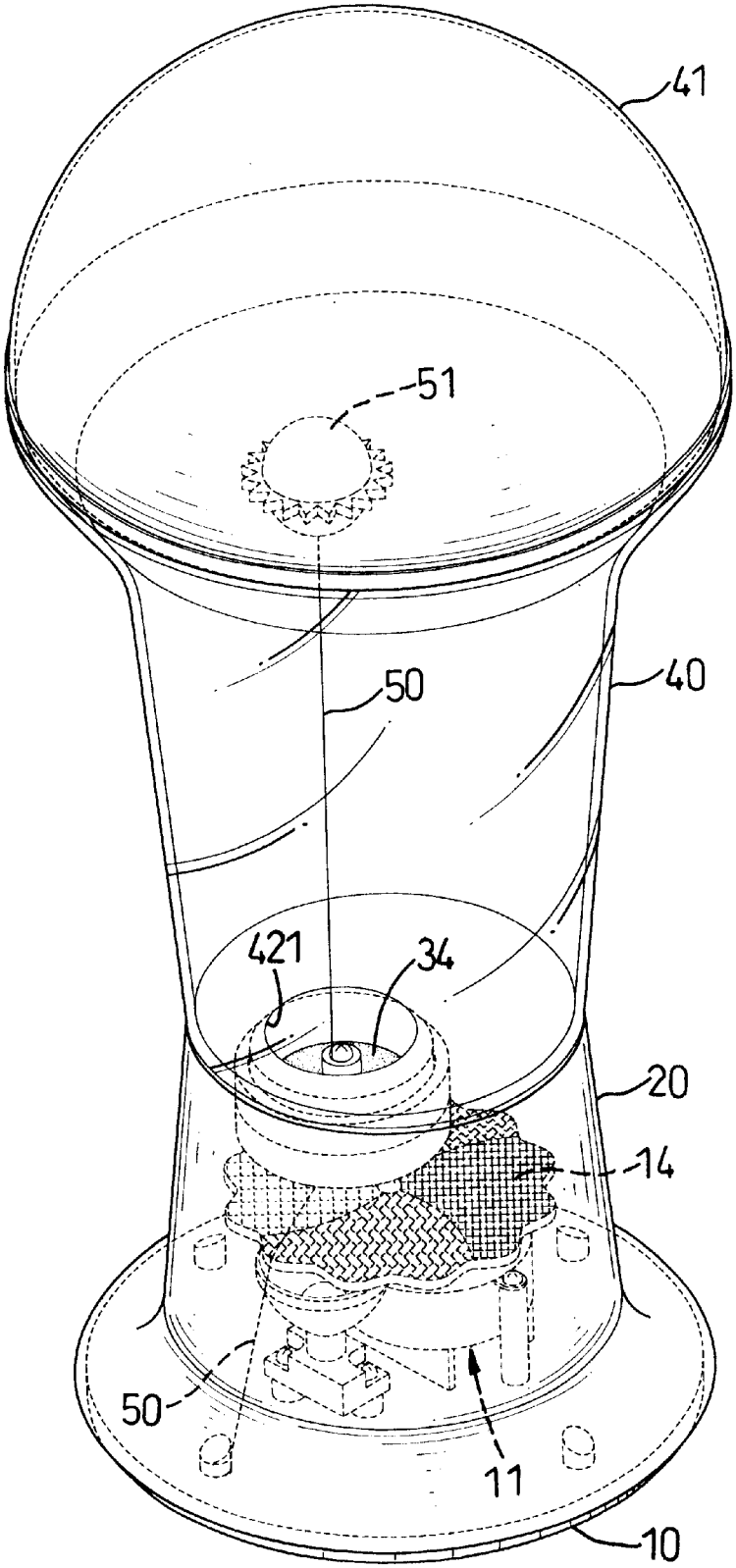
FIG. 2 is a perspective view of the decorative water lamp in combination.

All elements of the decorative water lamp in combination are shown in FIG. 2, wherein the base (10) with transmission device (11) is covered by the inner shell (20), and the outer shell (40) is mounted on the inner shell (20) with the membrane fixer (30) secured under the aperture (421).

Figure 3:
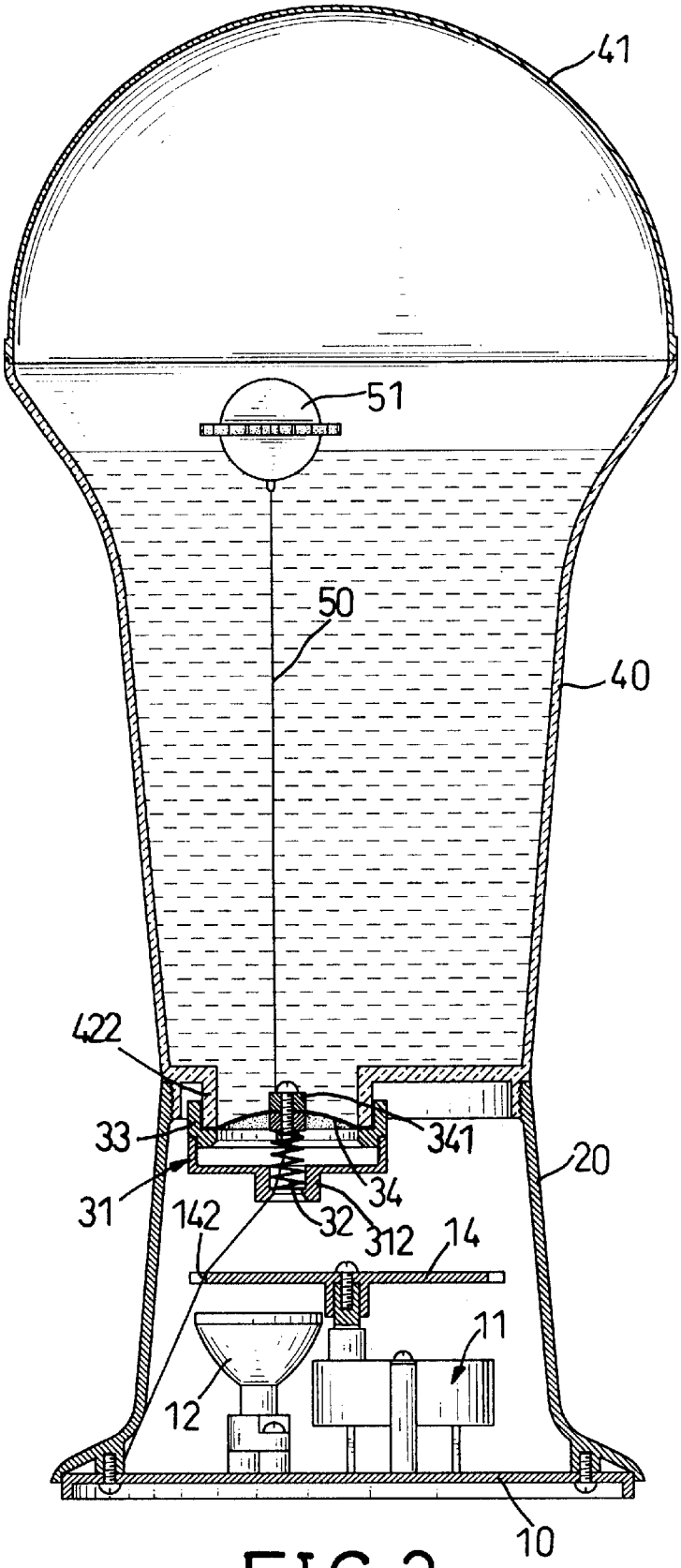
FIG. 3 is a cross-sectional side plane view of the decorative water lamp when a shell is filled with water.

FIG. 3 shows a clear structure of the membrane fixer (30) of the decorative water lamp in side plane view. The spring (32) is secured in the through hole (311) of the fixing cap (31) and connects with the pressure plate (341), and so as to push the resilient membrane (34) to deform. The fixing ring (33) mounts on the fixing cap (31) by fitting the cutout (332) to the threaded side wall (313) and sandwiches the membrane (34) with the support wall (422) of the plate (42). The line (50) abuts the plate (14) and is firmly secured on the membrane fixer (30), and the tapered portion (314) of the threaded side wall (313) decreases a friction between the line (50) and the fixing cap (31) when the line (50) is moved. The float body (51) is suspended in the water inside the outer shell (40).

Figure 4:
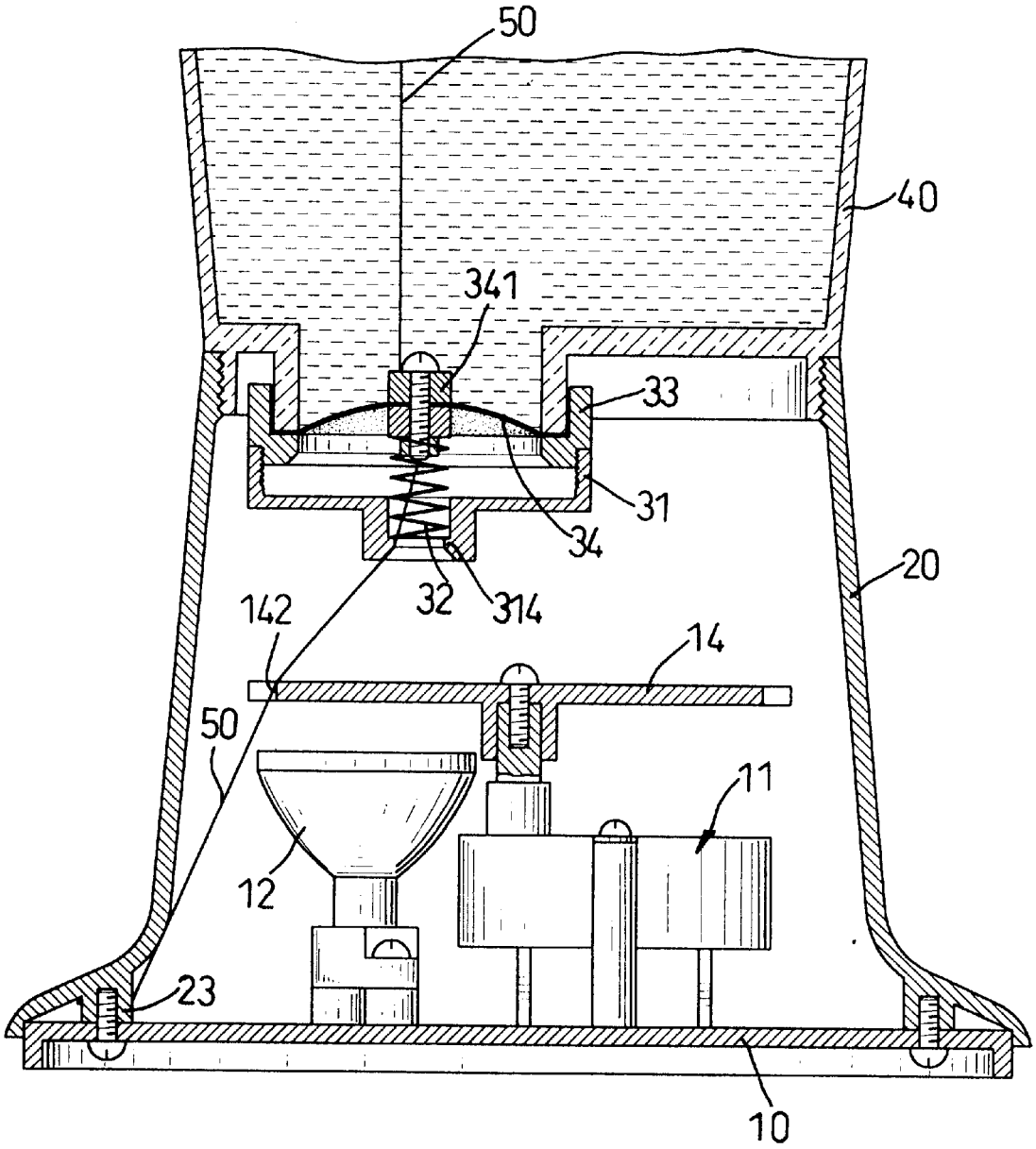
FIG. 4 is an enlarged side plane view of the base part of the decorative water lamp when a float thread moves to a wavy trough of a plate.
Figure 5:
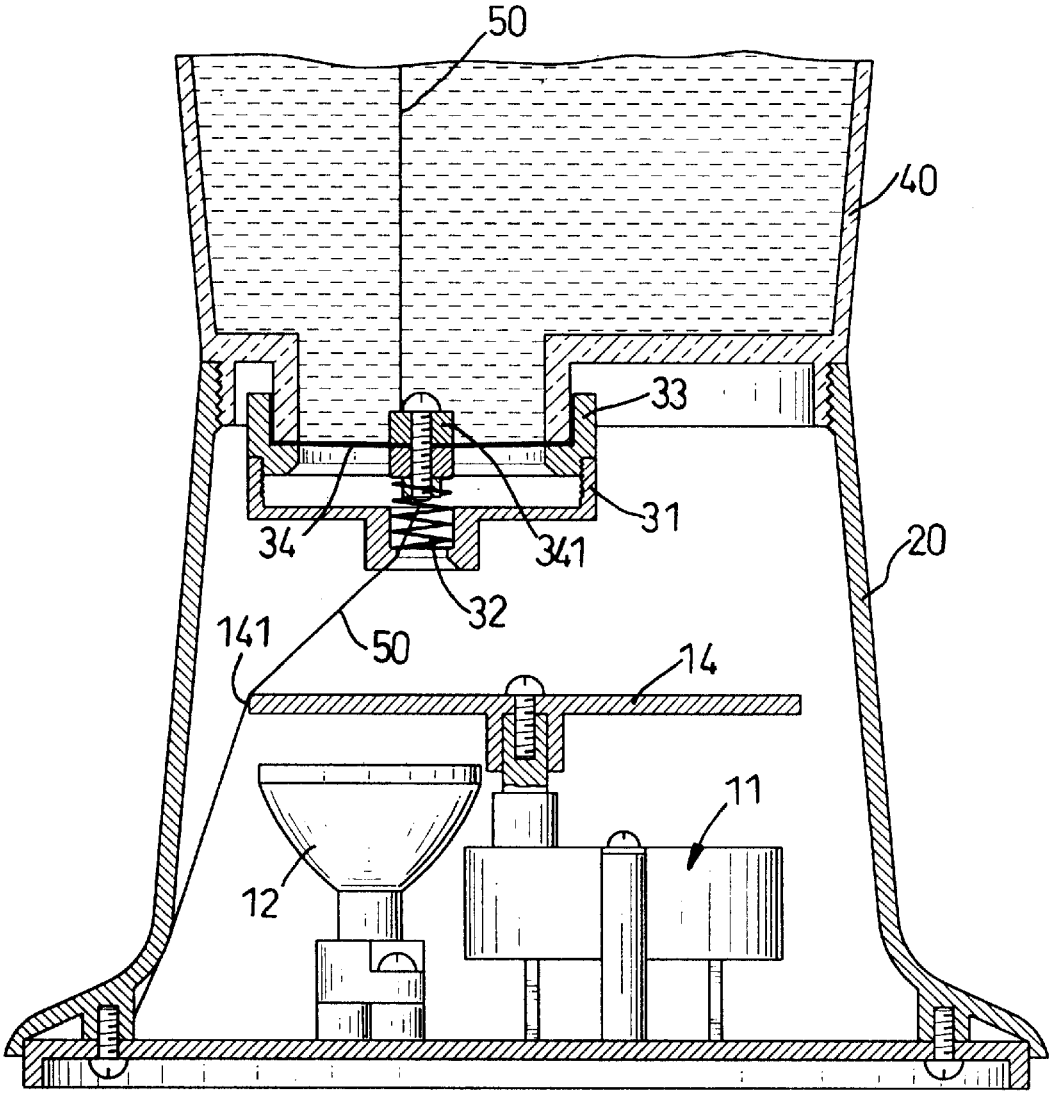
FIG. 5 is an enlarged side plane view of the base part of the decorative water lamp when the float thread moves to a wavy crest of the plate.
Figure 6:
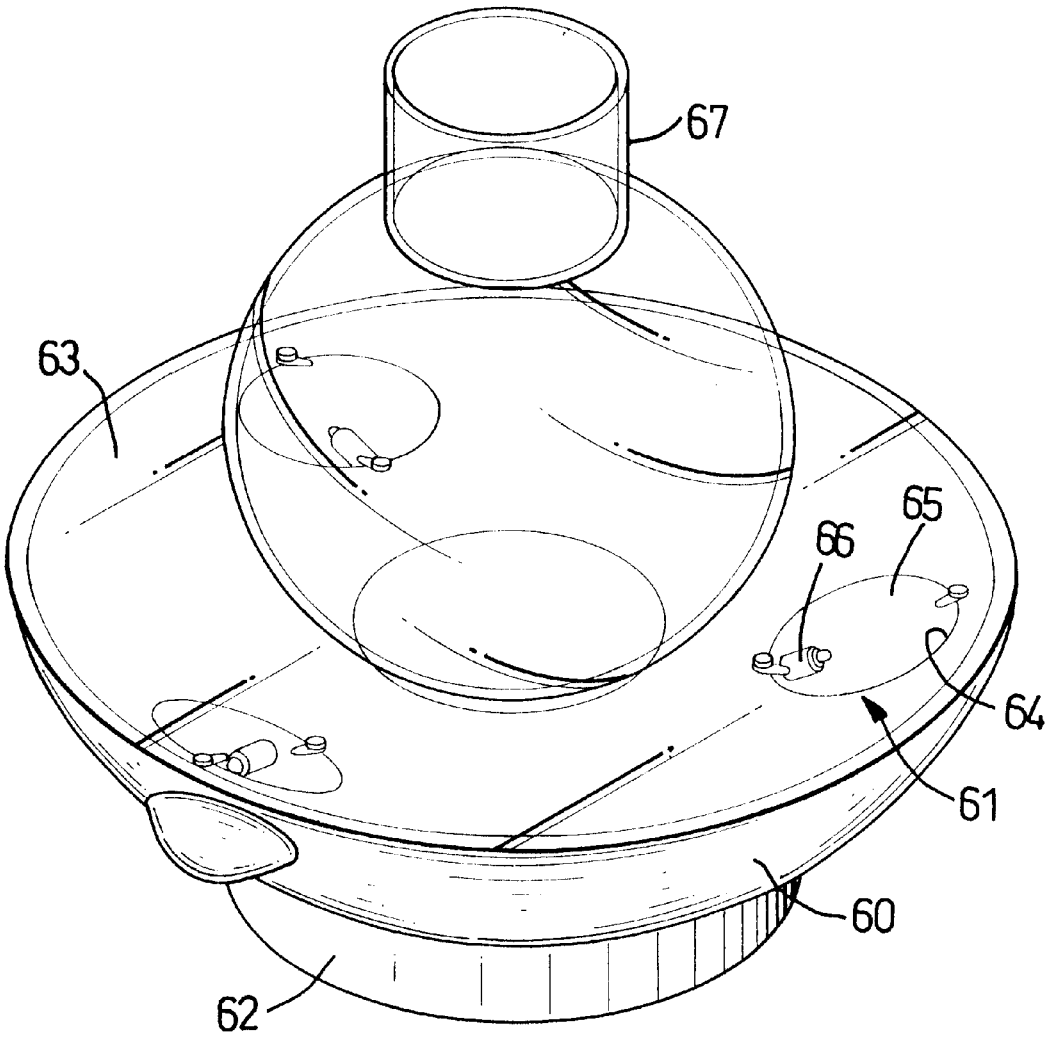
FIG.6 PRIOR ART
FIG. 6 is a perspective view of a first conventional water lamp.
Figure 7:
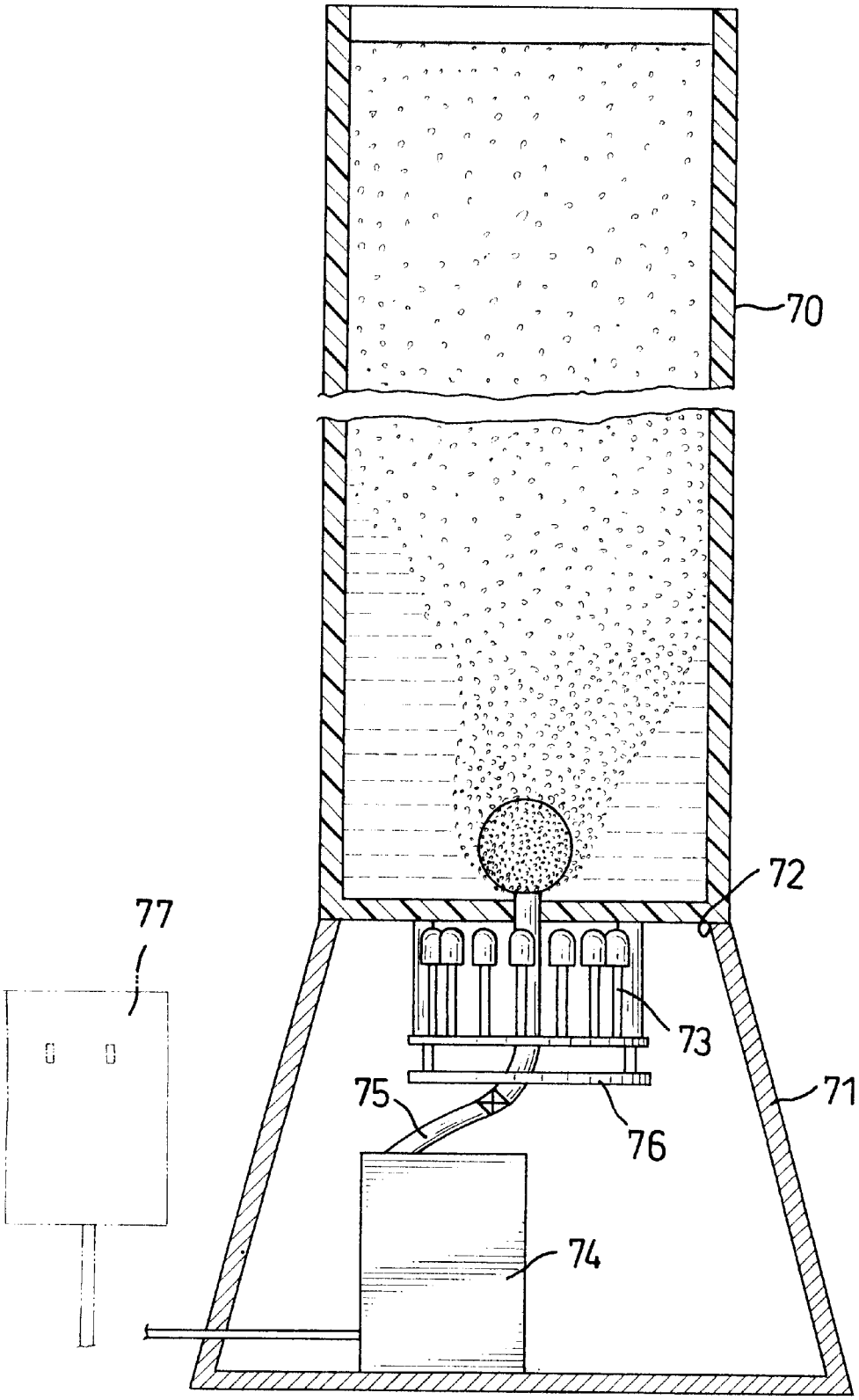
FIG.7 PRIOR ART
FIG. 7 is a perspective view of a second conventional water lamp.

Now referring to FIGS. 4 and 5, when the decorative water lamp operates, the transmission device (11) rotates the plate (14) and the line (50) moves side to side in accordance with the crests (151) and troughs (152) of the wavy edge (15) of the plate (14). In FIG. 4, the line (50) is placed in the trough (152) and a dragging force of the line (50) is weak so that the membrane (34) is pushed up by the spring (32). On the contrary, in FIG. 5, the line (50) is pushed out at the crest (151) of the plate (14) and the dragging force of the line (50) increases to pull the resilient membrane (34) down. Therefore, the resilient membrane (34) and the float body (51) are repeatedly moved by the line (50) to turbulence in the water when the plate (14) is rotating.

According to the above description, it is easy to be understood that the decorative water lamp has a colorful scene accompanying the turbulent water, and the waving waves refract the projected light to cause sparkling and dynamic visual effects in circumstances just like under the sea. Additionally, the decorative water lamp does not need many bulbs of different colors and thus the producing cost of the lamp is low.

However, even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative water lamp comprising:

a base (10);

a plate (14) rotatably mounted on the base (10);

a projector (12) emitting light on the plate (14) and mounted on the base (10);

a hollow inner shell (20) enclosing the base (10);

a transparent and hollow outer shell (40) secured on the inner shell (20) for receiving fluid therein and having an aperture (421) defined therein to communicate with the inner shell (20);

a wave generator received in the aperture (421) of the outer shell (40) for causing the fluid to be agitated to generate primary waves in the fluid, the wave generator is a membrane fixer (30) received in the aperture (421) of the outer shell (40) and composed of a fixing cap (31) having a through hole (311) defined therein, a threaded side wall (313) formed around the fixing cap (31);

a spring (32) secured between the fixing cap (31) and the membrane (34);

a fixing ring (33) sandwiched between the fixing cap (31) and the outer shell (40) and having a flange (331) inwardly formed and a threaded cutout (332) defined in the corner between the flange (331) and the fixing ring (33) to mate with the threaded side wall (313) of the fixing cap (31);

a resilient membrane (34) secured on the fixing ring (33); and two pressure plates (341) firmly sandwiching the resilient membrane (34); and a cover (41) mounted on the outer shell (40), whereby white light emitted from the projector (12) and passing through the plate (14) is refracted irregularly by the agitated fluid 3.

2. The decorative water lamp as claimed in claim 1, wherein the plate (14) with at least two different colors causes different colored lights to emanate from the white light emitted from the projector (12) and a wavy edge (15) to vibrate the wave generator.

3. The decorative water lamp as claimed in claim 1, wherein a line (50) has one end secured on the base (10), the other end secured on the wave generator, and a middle portion of the line (50) abutting the wavy edge (15) so that the rotation of the plate (14) vibrates the line (50) and the wavy generator.

4. The decorative water lamp as claimed in claim 2, wherein a line (50) has one end secured on the base (10), the other end secured on the wave generator, and a middle portion of the line (50) abutting the wavy edge (15) so that the rotation of the plate (14) vibrates the line (50) and the wavy generator.

5. The decorative water lamp as claimed in claim 3, wherein the line (50) extends to the outer shell (40) and binds with a float body (51) to cause secondary waves in the fluid.

6. The decorative water lamp as claimed in claim 4, wherein the line (50) extends to the outer shell (40) and binds with a float body (51) to cause secondary waves in the fluid.

7. The decorative water lamp as claimed in claim 3, wherein the fixing cap (31) has a ring (312) at a bottom face of the fixing cap (31) around the through hole (311), and the ring (312) has an outwardly tapered portion at a distal end to diminish friction between the line (50) and the fixing cap (31).

8. The decorative water lamp as claimed in claim 5, wherein the fixing cap (31) has a ring (312) at a bottom face of the fixing cap (31) around the through hole (311), and the ring (312) has an outwardly tapered portion at a distal end to diminish friction between the line (50) and the fixing cap (31).

9. The decorative water lamp as claimed in claim 1, wherein the fluid is water.

10. The decorative water lamp as claimed in claim 8, wherein the fluid is water.

* * * * *